US007334448B2

(12) United States Patent
Norin et al.

(10) Patent No.: US 7,334,448 B2
(45) Date of Patent: Feb. 26, 2008

(54) CRIMP TOOL AND A METHOD OF ASSEMBLING THEREOF

(75) Inventors: Mats Norin, Alvdalen (SE); John Hutchfield, Halstead (GB)

(73) Assignee: Pressmaster AB, Alvdalen (SE)

( * ) Notice: Subject to any disclaimer, the term of this patent is extended or adjusted under 35 U.S.C. 154(b) by 44 days.

(21) Appl. No.: 11/179,634

(22) Filed: Jul. 13, 2005

(65) Prior Publication Data

US 2006/0107725 A1 May 25, 2006

(30) Foreign Application Priority Data

Oct. 6, 2004 (SE) ..... 0402412

(51) Int. Cl.
*B21D 7/06* (2006.01)
*B21D 37/20* (2006.01)
*H01R 43/042* (2006.01)

(52) U.S. Cl. ..... 72/409.12; 72/409.19; 81/427.5; 29/751

(58) Field of Classification Search ..... 72/409.12, 72/409.01, 409.19; 29/751; 81/352, 427.5
See application file for complete search history.

(56) References Cited

U.S. PATENT DOCUMENTS 5,012,666 A * 5/1991 Chen et al. ..... 72/409.01
5,211,050 A * 5/1993 Gouveia et al. ..... 72/409.16
5,503,049 A * 4/1996 Chervenak et al. ..... 81/427.5
6,026,671 A * 2/2000 Battenfeld ..... 72/409.12
6,145,418 A * 11/2000 Bares ..... 81/421

* cited by examiner

*Primary Examiner*—Daniel C Crane
(74) *Attorney, Agent, or Firm*—Jacobson Holman PLLC

(57) ABSTRACT

A crimp tool and a method of assembling the crimp tool. The crimp tool is formed by a pair of handle plates forming a moveable handle and a pair of frame plates forming a fixed jaw and a fixed handle. The tool also includes a moveable jaw, and a transmission by which the moveable jaw is driven towards and away from the fixed jaw. The handle and frame plates respectively are mutually held in juxtaposition by having edge portions snugly received in handle and frame shells. The tool is assembled by stacking the plates of the moveable handle and the components of the moveable jaw and the link, as well as the frame plates, and then inserting the stack into the frame shell, which preferably has a tubular portion into which the jaw portion of the stack is inserted.

15 Claims, 5 Drawing Sheets

C-C
143
141
144
180
144
180

E
C
C
E
40
140
80
B
B
D
A
A
D

E-E
171
42
43
41
171
42
43

D-D
180
180
146
147
146

A-A
180
146
145
180
146

B-B
143
144
180
171
144
180
11
171

CRIMP TOOL AND A METHOD OF ASSEMBLING THEREOF

BACKGROUND OF THE INVENTION

1. Field of the Invention

The present invention relates to a manually operable crimp tool having a frame which includes a first fixed handle and a first fixed jaw, and a second moveable handle which is pivotable in relation to the frame and which includes a first pivotable link that is included in a transmission between the frame and a moveable jaw. The movable jaw is moveable in relation to the fixed jaw by the transmission in response to mutual pivoting of the handles. Each of the frame and the moveable handle includes two juxtaposed parallel separated plates. The moveable handle is provided with a grip shell including a spine, which covers the exterior edge of the moveable handle, and two parallel flanges which overlie the exterior sides of the plates of the moveable handle. The frame handle is provided with a shell including a spine, which covers the exterior edge of the fixed handle and two parallel flanges which overlie the exterior main sides of the plates of the frame.

2. Description of the Related Art

The present invention also refers to a method of assembling such crimp tool.

Prior art crimp tools usually comprise two sub-assemblies, each of which comprises two juxtaposed similar plates which are held in parallel at a mutual distance. To this end, fasteners are used, for example rivet pins. Opposed ends of the rivet pins extend through corresponding holes in the plates of each subassembly. The pins have an intermediate body portion of a diameter larger than that of the plate holes, in order to define a minimum distance between the plates. In a riveting operation, the pin ends, which may extend out of the holes, are deformed or riveted. These subassemblies are then mutually connected by a transmission. The handles are provided with handle grip shells to increase the comfort of the operator.

In such prior art tools, the operation of fastening such fasteners, for example riveting such rivet pins, adds to the cost of the tool.

Moreover, the pins and axles that are necessary to pivotably connect the subassemblies to each other and to the transmission are usually axially locked in place by locking rings and the like, and this also increases the cost of the tools.

SUMMARY OF THE INVENTION

One object of the invention is to provide a tool and an assembly method for the tool which do not require any riveting operation.

This object is attained by the invention.

The present invention achieves these objects by providing a crimp tool having a frame which includes a first fixed handle and a first fixed jaw, and a second moveable handle which is pivotable in relation to the frame and which includes a first pivotable link that is included in a transmission between the frame and a moveable jaw. The movable jaw is moveable in relation to the fixed jaw by the transmission in response to mutual pivoting of the handles. Each of the frame and the moveable handle includes two juxtaposed parallel separated plates. The moveable handle is provided with a grip shell including a spine, which covers the exterior edge of the moveable handle, and two parallel flanges which overlie the exterior sides of the plates of the moveable handle. The frame handle is provided with a shell including a spine, which covers the exterior edge of the fixed handle and two parallel flanges which overlie the exterior main sides of the plates of the frame. The spines of each of the shells have, on the inside thereof, a pair of parallel grooves in which the plates of the respective pair are received and held mutually parallel and juxtaposed.

The present invention also provides a method of assembling such crimp tool in which the plates of the moveable handle are placed on opposite sides of the link and the moveable jaw, and are connected to them via respective pins which protrude from opposite sides of the link and the moveable jaw. A frame plate is laid on a respective plate of the moveable handle, and the link is pivotably connected to the pair of frame plates. The shells are fitted to receive the edges of the plate pairs in the shell grooves.

According to a preferred embodiment, the flanges of the frame shell cover a head portion of the frame plates, including the fixed jaw, and the frame shell includes a tubular portion that surrounds the transition between the handle portion and the head portion of the frame. The tubular shell port and parallel grooves which receive opposite edge portions of the frame plates.

The frame plates can further be provided with elongated guide slots that receive projections on the moveable jaw.

BRIEF DESCRIPTION OF THE DRAWINGS

In the following, the invention will be further described in connection to referred embodiments.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
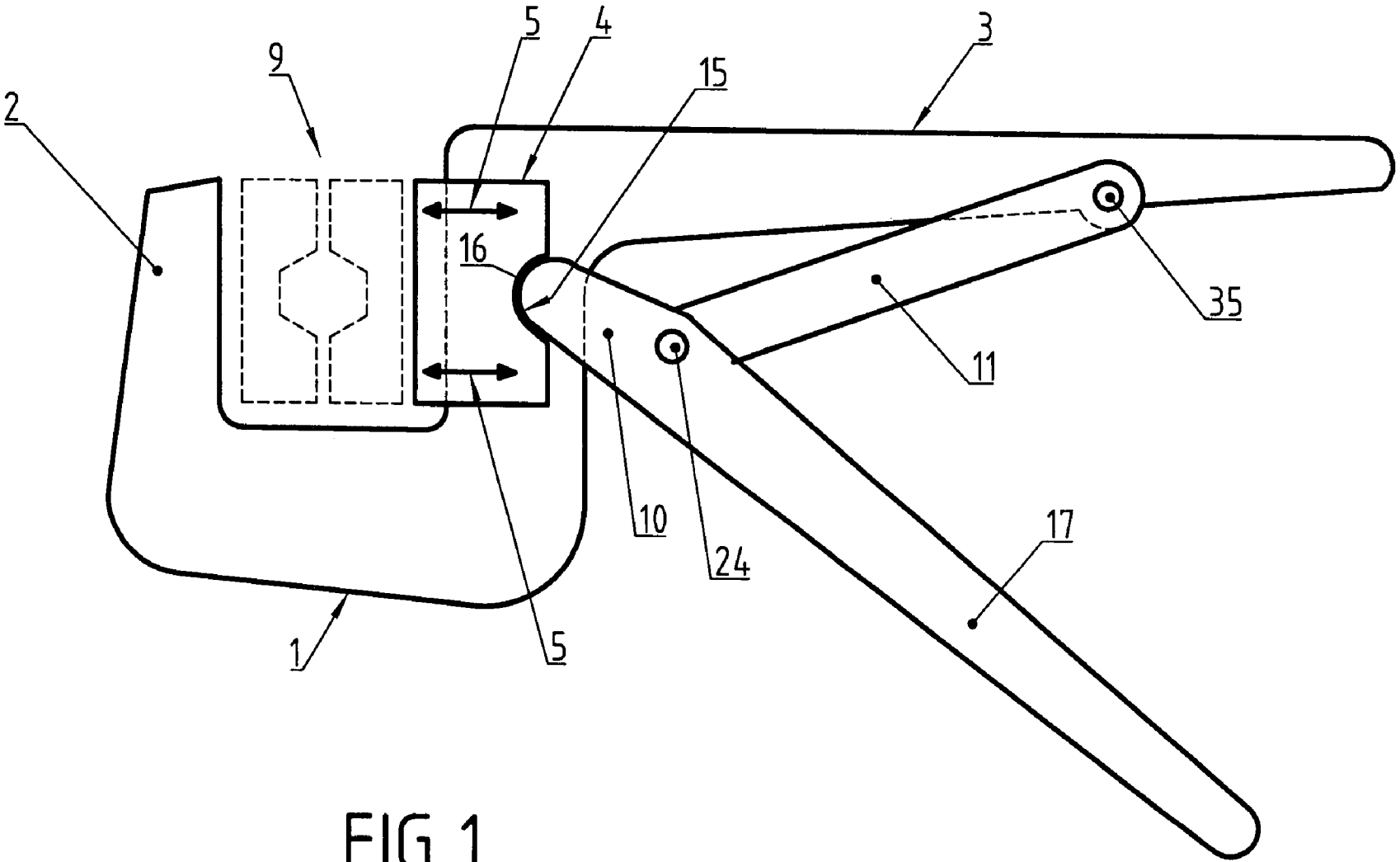
FIG. 1 shows a sketch illustrating the basic structure of a manual crimping tool.

FIG. 1 shows a frame 1, comprising a jaw 2 and a handle 3. A moveable jaw 4 is linearly guided on the frame 1 by guides 5 (illustrated in principle). The moveable jaw 4 has a surface which is parallel to the active surface of the fixed jaw 2 and is driven by a transmission for parallel displacement. The transmission includes a first link 10 and a second link 11, which are mutually pivotably connected by a pin 24. The upper end of link 11 is pivotably connected to the fixed handle 3 by a pivot pin 35. The top end 15 of the first link 10 is curved and received in a curved recess 16 of the moveable jaw 4. A handle 17 is fixedly connected to the link 10. When the handle 17 is swung toward the fixed handle 3, the links 10 and 11 are mutually swung toward alignment, whereby the moveable jaw 4 is pushed by the link 10 in direction toward the fixed jaw 2.

A pair of crimp sockets 9 is located between the jaws 2, 4 and are clamped to a crimping end position when the links 10, 11 come near alignment.

Figure 2:
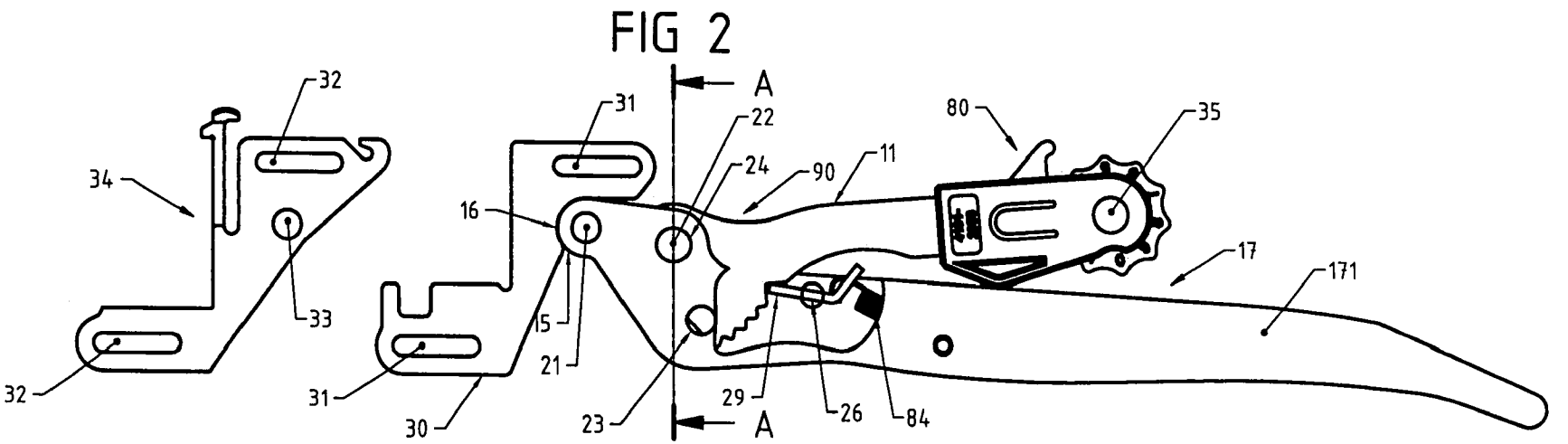
FIG. 2 shows an expanded side view of a sub-assembly of a crimp tool.

The handle 17 (including the link 10) includes two parallel juxtaposed plates 171 (FIG. 2). The plates 171 have aligned holes 22, which receive a pivot pin 24, that extends through a bore in the end part of link 11. FIG. 2 shows that the moveable jaw 4 is formed by two parallel jaw plates 30 having guide slots 31 which receive corresponding elongated projections 32 on a holder 34 for the crimp sockets 9, which are received between the plates 30. The holder 34 also has a pair of oppositely directed aligned pins 33 which are received in corresponding holes 21 at the upper end of link 10.

Figure 4:
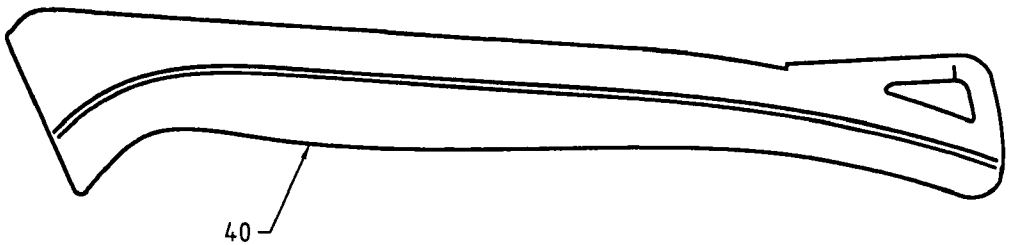
FIG. 4 shows a side view of a grip shell for the sub-assembly of FIG. 2.

The moveable jaw, the handle 17 and the link 11 are subassembled, and a handle grip shell 40 (FIG. 4) is fitted on the handle plates 171. The shell 40 comprises (FIG. 14) a spine 41 along the length thereof, which supports two parallel flanges 42 that overlie the plates 171. The exterior long edges of plates 171 are snugly received in grooves 43 in the shell spine 41, and are thus held in parallel at a predetermined distance from each other. Moreover, the grooves also hold the plates 171 juxtaposed. As shown in FIG. 2, the plates 171 can have one or more holes 23 which receive corresponding shallow protrusions from the insides of the shell flanges to further stabilize the press fit between the shell 40 and the handle 17.

Figures 6, 7, 8:
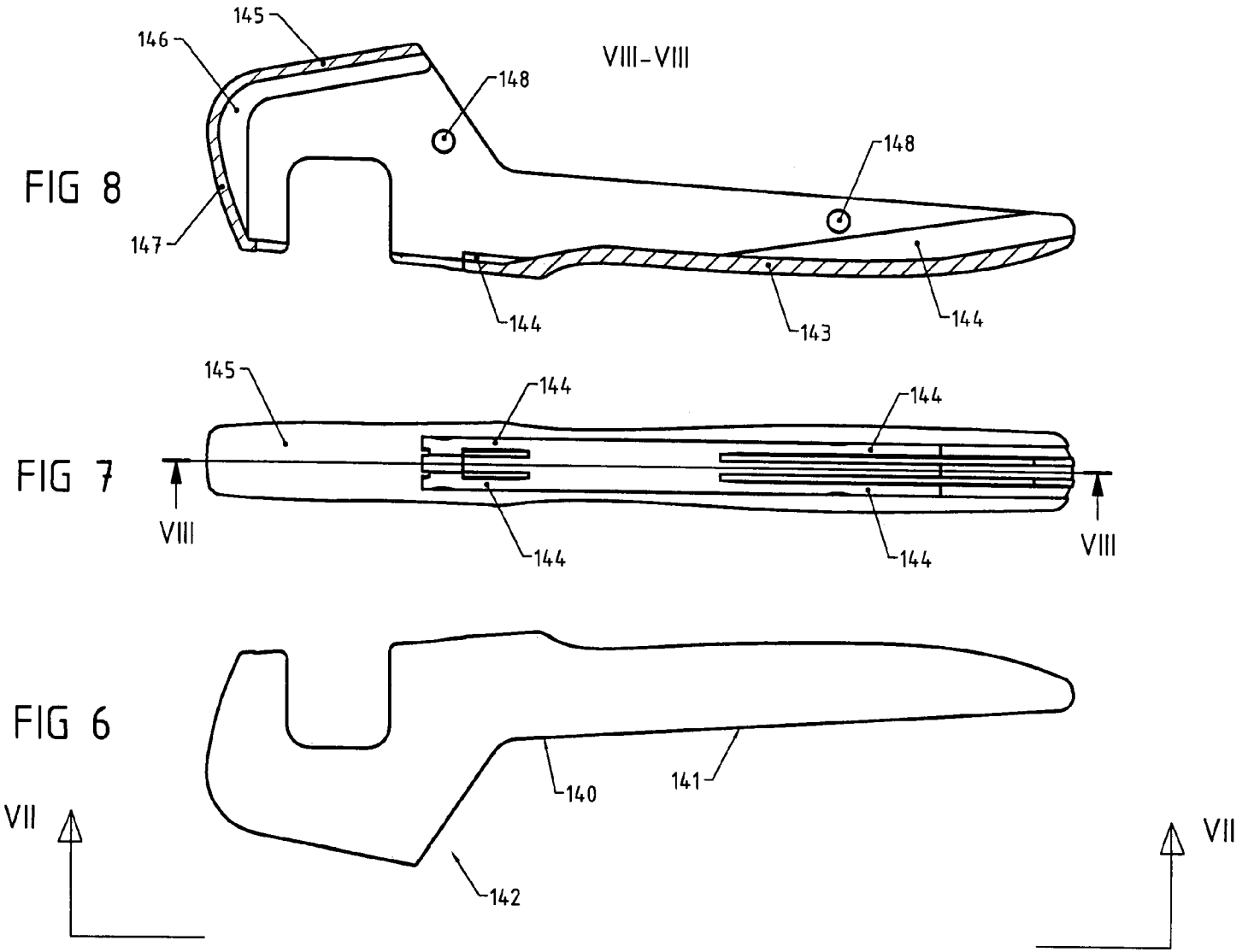
FIG. 6 shows a view over one side of a shell for the frame part of the crimp tool.
FIG. 7 shows a view taken along line VII-VII in FIG. 6.
FIG. 8 shows a section taken along line VIII-VIII in FIG. 7.

The frame 1 is formed by two parallel plates 18 (FIG. 5) which are juxtaposed and mutually parallel and maintain a mutual distance by having the edges thereof snugly inserted into grooves on the inside of a frame shell 140 (FIGS. 6, 7, 8).

Figure 3:
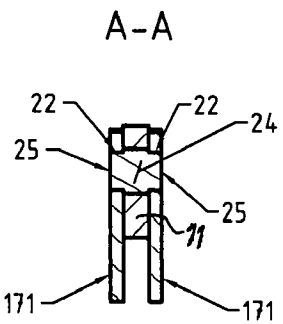
FIG. 3 schematically shows a section taken along line III-III in FIG. 2.

FIG. 3 illustrates that the ends 25 of the axle pin 24 are received in the openings 22 of the plates 171. The enlarged intermediate portion of pin 24 supports the plates 171, and the pin ends 25 do not protrude from the plates. The pin 24 does not have to perform any axially supporting function, since the plates 171 are held at a mutual distance defined by the grooves on the inside of the spine in shell 40.

Figure 5:
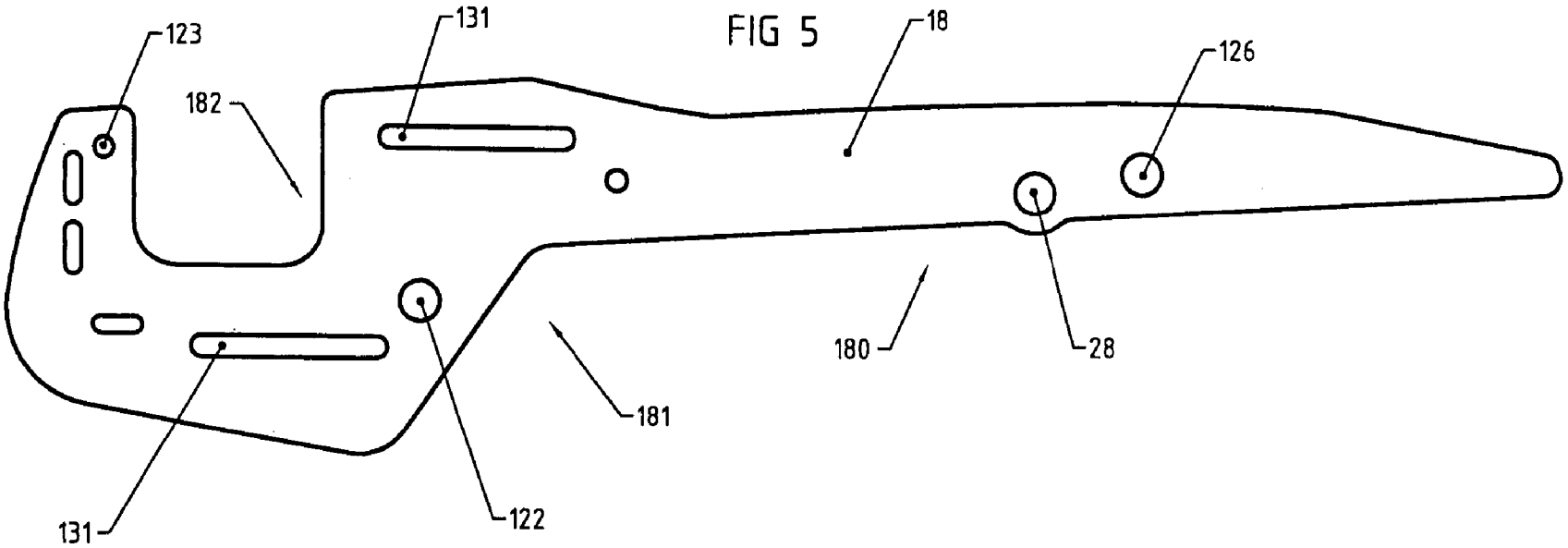
FIG. 5 shows one of a pair of pivot frame plates to be fitted to the sub-assembly of FIG. 2.

FIG. 5 illustrates that the frame 1 is formed by a pair of juxtaposed identical frame plates 18 including a handle portion 180 and a head portion 181 having a recess 182. The plates 18 have guide slits 131 for the protrusions 32 of the holder 34.

The frame shell 140 is shown to have a generally U-shaped handle portion 141 and a head portion 142, which receives the head portion 181 of the frame plates. As can be seen from FIGS. 7 and 8, the head portion 142 has a tubular cross section, at the transition between the handle part 141 and the head part 142.

The handle portion 141 has a general U-shape including a spine 143 which covers the exterior edge of the handle of the frame, and two flanges which cover the opposed exterior sides of the pair of plates 18. The spine 143 has grooves 144 (see FIGS. 11 and 13) which snugly receive and grip the adjacent edges of plates 18 to hold them parallel and juxtaposed. FIG. 8 clearly shows that the frame shell 140 has a spine 145 also along the side opposite to spine 143 and along the top end 147 of the head portion 142. Grooves 146 are arranged along the inside of spine 145 (see FIGS. 10 and 12) and serve to further stabilize the mutual positioning and distance for plates 18. FIG. 8 also shows shallow protrusions 148 which can be received in corresponding openings (122, 126) in plates 18 to improve the engagement of the plates in the shell 140.

FIG. 8 also shows that the spines 143, 145 slightly converge toward the top end 147 of a shell 140, and that the tubular part of the shell 140 offers strength to the shell 140.

The link arm 11 is shown to comprise a prior art adjustment device 80, which permits adjustment to the effective length of link 11 between its connections 24, 35 to the handles 17 and 18. The subassembly is also shown to comprise a prior art ratchet device 90, which ensures that the crimp tool must be fully closed to an end position before it can be reopened for a new crimping operation. The ratchet device 90 normally includes a pivot pin 26 which is inserted through aligned holes in the handle plates 171 and supports a pawl 29 which can be swung around said pin to and from engagement with a row of teeth on a head of link arm 11. The pawl is in turn biased by a spring 84.

Figures 9, 10, 11, 12, 13, 14:
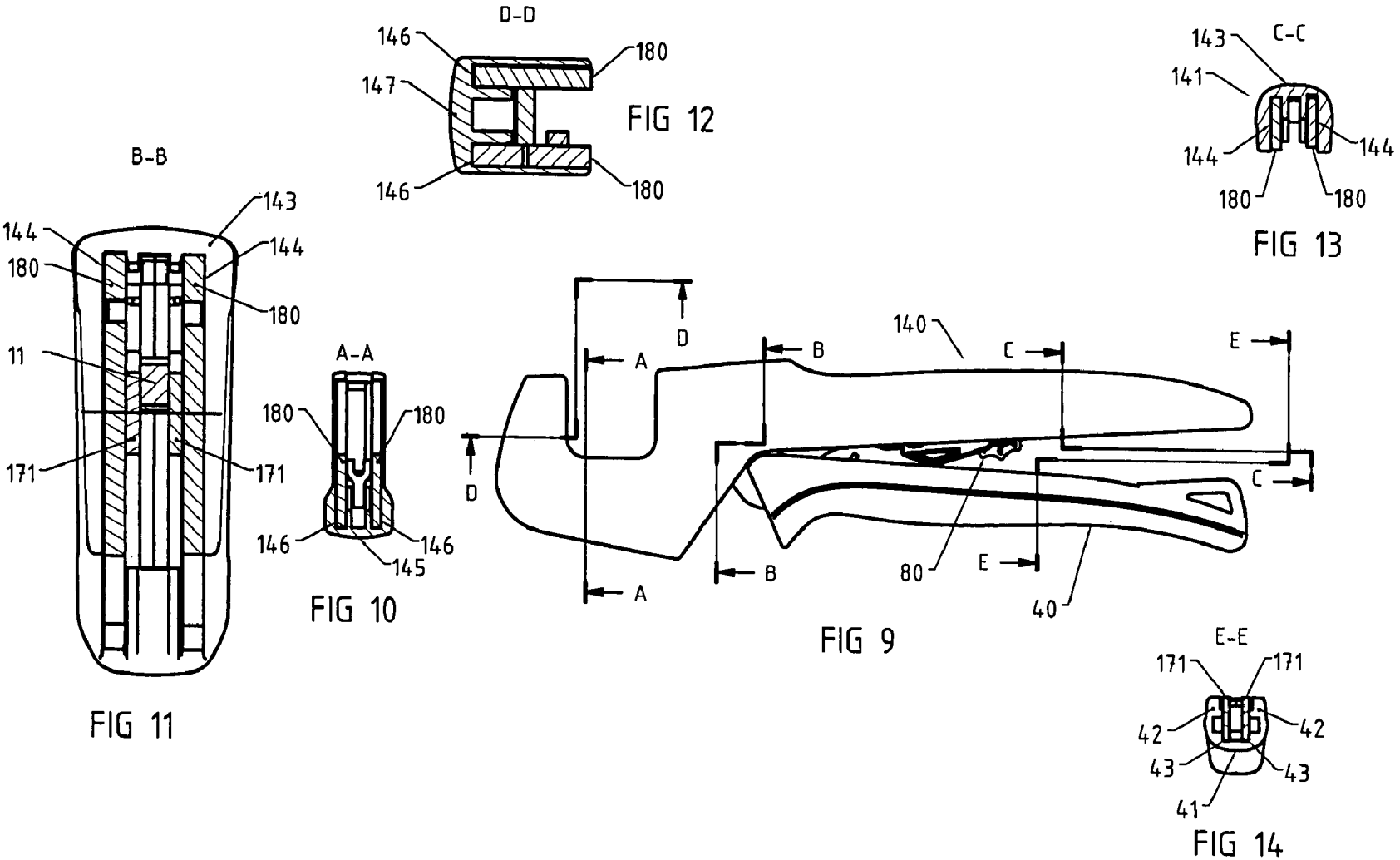
FIG. 9 shows a side view of a tool as assembled.
FIG. 10-13 show sections taken along lines A-A, B-B, D-D and C-C, respectively in FIG. 9.
FIG. 14 shows a section along line XIV-XIV in FIG. 4.

The shells 40, 140 are to advantage made from a moulded plastics material. Starting from the subassembly according to FIG. 2, the shells 40 can be fitted to the plates 171 to stabilize the subassembly. Then the frame plates 18 can be laid on opposite sides of the finished subassembly so that the guide slots 131 receive the protrusions 32 extending through the slits 31. This assembly, which in principle is constituted by a stack of elements which are only loosely held together, is now inserted into the tubular part of the frame shell 140 so that the edges of plates 18 engage the grooves 144, 146 therein. The tool is now operatively assembled as shown in FIG. 9, and can be taken into operation.

The pairs of plates 171, 171 and 18, 18, are held in mutual positions by the grooves in the respective shell so that the plates 171, 180 can take the forces from the links and the jaws during operation.

The juxtaposition of the pairs of plates 171, 171, 18, 18, can be supported by pins extending through aligned holes in each pair. As the plates of the plate pairs are supported by the shells, they can be held at a slight distance from each other. Pins and axles do not have to be fastened.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. A crimp tool comprising:

a frame formed by two juxtaposed parallel-spaced frame plates that have a head portion and a handle portion that define a fixed jaw and a fixed handle, respectively;

a movable jaw mounted on said frame so as to be movable in relation to said fixed jaw;

a moveable handle which is pivotable in relation to the frame, said moveable handle formed by two juxtaposed parallel-spaced handle plates and including a first pivotable link that is part of a transmission between the frame and said moveable jaw that moves said moveable jaw in relation to the fixed jaw in response to mutual pivoting of the handles;

a grip shell fitted on said moveable handle and including a spine which covers an exterior edge of said moveable handle and two parallel flanges which overlie exterior sides of said handle plates;

a frame shell fitted on said fixed handle and including a spine which covers an exterior edge of said fixed handle and two parallel flanges which overlie exterior main sides of said frame plates and cover said head portion of said frame; and the spines of said grip shell and said frame shell each having, on an inside thereof, a pair of parallel grooves in which the handle plates and the frame plates, respectively, are received and held mutually parallel and juxtaposed.

2. The crimp tool according to claim 1, wherein the flanges of the frame shell are extended to cover the fixed jaw.

3. The crimp tool according to claim 1, wherein the frame shell has a tubular portion surrounding a transition between the handle portion and the head portion of the frame.

4. The crimp tool according to claim 3, wherein the tubular shell portion has opposite spines connecting the flanges thereof and parallel grooves which receive opposite edge portions of the frame plates.

5. The crimp tool according to claim 1, wherein the frame plates have guide slots which receive projections on the moveable jaw.

6. A crimp tool comprising:

a frame formed by two juxtaposed frame plates that include a head portion defining a fixed jaw and a handle portion defining a fixed handle;

a movable jaw mounted on said frame so as to be movable in relation to said fixed jaw;

a moveable handle which is pivotable in relation to the frame, said moveable handle formed by two juxtaposed handle plates and including a first pivotable link that is part of a transmission between the frame and said moveable jaw that moves said moveable jaw in relation to the fixed jaw in response to mutual pivoting of the handles;

a grip shell fitted on said moveable handle;

a frame shell fitted on said fixed handle and including a tubular portion that surrounds a transition between said handle portion and said head portion of the frame; and said handle plates and said frame plates being received in corresponding grooves in said grip shell and corresponding grooves of said frame shell, respectively, and thereby held in said juxtaposed relationship.

7. The crimp tool according to claim 6, wherein the frame shell includes a generally U-shaped frame shell handle portion that receives the handle portion of the frame plates, and a frame shell head portion that receives the head portion of said frame plates.

8. The crimp tool according to claim 7, wherein the frame shell handle portion has a first spine that covers an exterior edge of the fixed handle and two flanges which cover opposed exterior sides of the frame plates.

9. The crimp tool according to claim 8, wherein the frame shell head portion has a second spine along a side opposite said first spine.

10. The crimp tool according to claim 9, wherein both said first and second spines include grooves that receive and grip adjacent edges of said frame plates.

11. The crimp tool according to claim 9, wherein said first and second spines slightly converge toward a top end of said frame shell.

12. The crimp tool according to claim 6, wherein the frame plates have guide slots which receive projections on the moveable jaw.

13. A method of assembling a crimp tool having a frame formed by two juxtaposed frame plates that include a head portion defining a fixed jaw and a handle portion defining a fixed handle; a movable jaw mounted on said frame so as to be movable in relation to said fixed jaw; a moveable handle which is pivotable in relation to the frame, said moveable handle formed by two juxtaposed handle plates and including a first pivotable link that is part of a transmission between the frame and said moveable jaw that moves said moveable jaw in relation to the fixed jaw in response to mutual pivoting of the handles; a grip shell fitted on said moveable handle; a frame shell fitted on said fixed handle and including a tubular portion that surrounds a transition between said handle portion and said head portion of the frame; and said handle plates and said frame plates being received in corresponding grooves in said grip shell and said frame shell, respectively, and thereby held in said juxtaposed relationship, said method comprising:

placing the handle plates of the moveable handle on opposite side of the link and the moveable jaw;

connecting the handle plates to the link and the moveable jaw via respective pins which protrude from opposite sides of the link and the moveable jaw;

stacking a frame plate on a respective plate of the moveable handle; and pivotably connecting said link to the pair of frame plates; and fitting the shells to receive the edges of each plate pair in the shell grooves of each shell and surrounding a transition between the handle and head portion of the frame with a tubular portion of the shell.

14. The method according to claim 13, wherein the step of pivotally connecting includes inserting protrusions on said moveable jaw into guide slots on said frame plates.

15. The method according to claim 13, wherein the step of fitting the shells includes inserting a jaw portion of the stacked plates into a tubular part of said frame shell so that edges of said frame plates engage the grooves in said frame shell.

* * * * *